US009669962B2

(12) United States Patent
Liao et al.

(10) Patent No.: US 9,669,962 B2
(45) Date of Patent: Jun. 6, 2017

(54) SIZE ADJUSTABLE ASSEMBLABLE PALLET

(71) Applicants: AIR-BAG PACKING CO., LTD., New Taipei (TW); Yaw-Shin Liao, New Taipei (TW)

(72) Inventors: Yaw-Shin Liao, New Taipei (TW); Chieh-Hua Liao, New Taipei (TW); Kao-Hsiung Liao, New Taipei (TW)

(73) Assignees: Air-Bag Packing Co., Ltd., New Taipei (TW); Yaw-Shin Liao, New Taipei (TW)

( * ) Notice: Subject to any disclaimer, the term of this patent is extended or adjusted under 35 U.S.C. 154(b) by 0 days.

(21) Appl. No.: 14/936,378

(22) Filed: Nov. 9, 2015

(65) Prior Publication Data

US 2016/0137342 A1 May 19, 2016

(30) Foreign Application Priority Data

Nov. 19, 2014 (TW) ..... 103140132 A

(51) Int. Cl.
*B65D 19/38* (2006.01)
*B65D 19/00* (2006.01)

(52) U.S. Cl.
CPC ..... *B65D 19/0097* (2013.01); *B65D 19/0095* (2013.01); *B65D 2519/00024* (2013.01);
(Continued)

(58) Field of Classification Search
CPC ..... B65D 19/0026; B65D 19/0028; B65D 19/0089; B65D 19/0095; B65D 19/0097; B65D 19/44; B65D 2519/00333; B65D 2519/00298; B65D 2519/00104; B65D 2519/00567; B65D 2519/00129; B65D 2519/00985; B65D 2519/00273; B65D 2519/00323; B65D 2519/00562; B65D 2519/00815; B65D 2519/00024; B65D 2519/00034; B65D 2519/00044;
(Continued)

(56) References Cited

U.S. PATENT DOCUMENTS 2,918,190 A * 12/1959 Martin ..... B65D 19/0018 220/4.28
2,955,791 A * 10/1960 George ..... B65D 19/0028 108/57.31

(Continued)

*Primary Examiner* — Hanh V Tran
(74) *Attorney, Agent, or Firm* — Muncy, Geissler, Olds & Lowe, P.C.

(57) ABSTRACT

A size adjustable assemblable pallet includes a central base member and multiple side base members, connecting bars, and loading plates. The central base member has a main body, which defines multiple positioning grooves that cross at a junction. Each side base member has a base body, which defines multiple fixing grooves. Each connecting bar has a main portion and multiple inserting portions. The inserting portions are bent extendingly in a same direction from respective ends of the main portion. The inserting portions are inserted into the fixing grooves of two side base members or one of the fixing grooves of one side base member and one of the positioning grooves of the central base member, in order to secure the central base member and/or side base members. The loading plates are secured to the side base members or the connecting bars.

22 Claims, 17 Drawing Sheets

(52) U.S. Cl.
CPC ..... *B65D 2519/00034* (2013.01); *B65D 2519/00044* (2013.01); *B65D 2519/00059* (2013.01); *B65D 2519/00069* (2013.01); *B65D 2519/00079* (2013.01); *B65D 2519/0099* (2013.01); *B65D 2519/00104* (2013.01); *B65D 2519/00273* (2013.01); *B65D 2519/00293* (2013.01); *B65D 2519/00298* (2013.01); *B65D 2519/00323* (2013.01); *B65D 2519/00333* (2013.01); *B65D 2519/00338* (2013.01); *B65D 2519/00348* (2013.01); *B65D 2519/00353* (2013.01); *B65D 2519/00373* (2013.01); *B65D 2519/00407* (2013.01); *B65D 2519/00412* (2013.01); *B65D 2519/00417* (2013.01); *B65D 2519/00562* (2013.01); *B65D 2519/00567* (2013.01); *B65D 2519/00761* (2013.01); *B65D 2519/00766* (2013.01)

(58) Field of Classification Search
CPC ..... B65D 2519/00059; B65D 2519/00069; B65D 2519/00079; B65D 2519/00293; B65D 2519/00348; B65D 2519/00353; B65D 2519/00373; B65D 2519/00407; B65D 2519/00412; B65D 2519/00417; B65D 2519/00761; B65D 2519/0099
USPC ..... 108/54.1, 56.1, 56.3, 57.19
See application file for complete search history.

(56) References Cited

U.S. PATENT DOCUMENTS 3,981,249 A * 9/1976 Herrmann ..... B65D 19/0095 108/52.1
4,230,050 A * 10/1980 Mays ..... B65D 19/0095 108/57.17
4,869,179 A * 9/1989 Sammons ..... B65D 19/0073 108/56.1
5,404,829 A * 4/1995 Shuert ..... B65D 19/0022 108/57.26
5,413,052 A * 5/1995 Breezer ..... B65D 19/0012 108/56.1
5,544,374 A * 8/1996 Strobel ..... A47C 19/024 108/159
5,636,577 A * 6/1997 Gow ..... B65D 19/0095 108/51.3
5,687,653 A * 11/1997 Bumgarner ..... B65D 19/0091 108/56.3
5,758,855 A * 6/1998 Jordan ..... B65D 19/0026 156/196
5,836,255 A * 11/1998 Uitz ..... B65D 19/0069 108/57.25
6,105,512 A * 8/2000 Lin ..... B65D 19/0073 108/55.5
6,109,190 A * 8/2000 Hale ..... B65D 19/0016 108/57.25
6,199,488 B1 * 3/2001 Favaron ..... B65D 19/0012 108/57.25
6,622,642 B2 * 9/2003 Ohanesian ..... B65D 19/0012 108/53.3
7,661,373 B2 * 2/2010 Apps ..... B65D 19/0012 108/56.3
9,139,334 B2 * 9/2015 Wahl ..... B65D 19/0016
9,150,350 B2 * 10/2015 Stanek ..... B65D 90/24
9,452,864 B2 * 9/2016 Apps ..... B65D 19/0016
2002/0011194 A1 * 1/2002 Lacabanne ..... B65D 19/0085 108/57.19
2002/0112653 A1 * 8/2002 Moore, Jr. ..... B65D 19/0012 108/57.25
2003/0233963 A1 * 12/2003 Fan ..... B65D 19/0012 108/51.11
2004/0216648 A1 * 11/2004 Apps ..... B65D 19/0012 108/57.25
2004/0218276 A1 * 11/2004 Apps ..... B65D 19/0012 359/582
2006/0102055 A1 * 5/2006 Wu ..... B65D 19/0028 108/51.3
2006/0201402 A1 * 9/2006 Moore ..... B65D 19/0012 108/57.25
2007/0256614 A1 * 11/2007 Chen ..... B65D 19/0069 108/153.1
2008/0035033 A1 * 2/2008 Liebel ..... B65D 19/0026 108/56.1
2008/0295748 A1 * 12/2008 Yoshida ..... B65D 19/0026 108/55.1
2009/0188412 A1 * 7/2009 Dubois ..... B65D 19/0022 108/57.25
2010/0154685 A1 * 6/2010 Arinstein ..... B65D 19/0018 108/57.16
2011/0303128 A1 * 12/2011 Linares ..... B65D 19/0012 108/51.3
2012/0325125 A1 * 12/2012 Apps ..... B65D 19/0014 108/57.25
2013/0174762 A1 * 7/2013 Hedley ..... B65D 19/0026 108/50.11
2014/0000218 A1 * 1/2014 Kelly ..... B65B 15/00 53/399
2014/0113092 A1 * 4/2014 Doll ..... B65D 19/385 428/36.5

* cited by examiner

SIZE ADJUSTABLE ASSEMBLABLE PALLET

CROSS-REFERENCES TO RELATED APPLICATIONS

This non-provisional application claims priority under 35 U.S.C. §119(a) on Patent Application No. 103140132 filed in Taiwan, R.O.C. on Nov. 19, 2014 the entire contents of which are hereby incorporated by reference.

BACKGROUND

Technical Field

The instant disclosure relates to an assemblable pallet, in particular to a size adjustable assemblable pallet.

Related Art

As known, most conventional pallets are formed integrally in one piece. A pallet of different size must be manufactured from a corresponding mold, which is very expensive. Additionally, if the pallet is hit and only looses a small corner portion, the whole pallet must be discarded. Therefore, a cost-effective repeated usage pallet, has always been desired.

SUMMARY

To address this issue, the instant disclosure provides a size adjustable assemblable pallet, which is capable of size adjustment in horizontal and vertical directions.

In one embodiment, the assemblable pallet comprises a central base member and a plurality of side base members, connecting bars, and loading plates. The central base member includes a main body and a plurality of positioning grooves formed thereon. The positioning grooves cross one another at a junction. Each of the side base members includes a base body and a plurality of fixing grooves formed thereon. Each of the connecting bars has a main portion and a plurality of inserting portions. The inserting portions are bent and extend in a same direction from respective ends of the main portion. For each connecting bar, the main portion is received by the fixing grooves of two side base members, in order to interconnect adjacent side base members. In addition, the main portion may also be received by one of the fixing grooves of one side base member and one of the positioning grooves of the central base member, in order to interconnect one side base member with the central base member. The loading plates are secured onto the side base members.

For another embodiment, the loading plates are secured onto the connecting bars instead.

The pallet of the instant disclosure has the following attributes. Since the inserting portions may be inserted into different fixing holes of the side base members, the distance between adjacent side base members can be adjusted accordingly. That is, the length and width of the pallet frame can be conveniently adjusted based on the actual working requirements. If any side base member is damaged due to inadvertent impact, the damaged piece may be replaced such that the pallet may continue to be reused. This attribute reduces operation costs significantly. In addition, each of the side base members has ribbed interior structures with the shape of H, I or X. The ribbed interior structures reduce the weight of each side base member, while greatly enhancing the supporting strength thereof. Additionally, the interconnected side base members and connecting bars provide a smooth and even-planed frame body. This frame body is structurally rigid and balanced, so that the components will not be displaced or misaligned, assuring work safety when the pallet is being transported or used in carrying goods.

A detailed description of the characteristics and the advantages of the disclosure is shown in the following embodiments, the technical content and the implementation of the disclosure should be readily apparent to any person skilled in the art from the detailed description, and the purposes and the advantages of the disclosure should be readily understood by any person skilled in the art with reference to content, claims and drawings in the disclosure.

DETAILED DESCRIPTION

Figure 1:
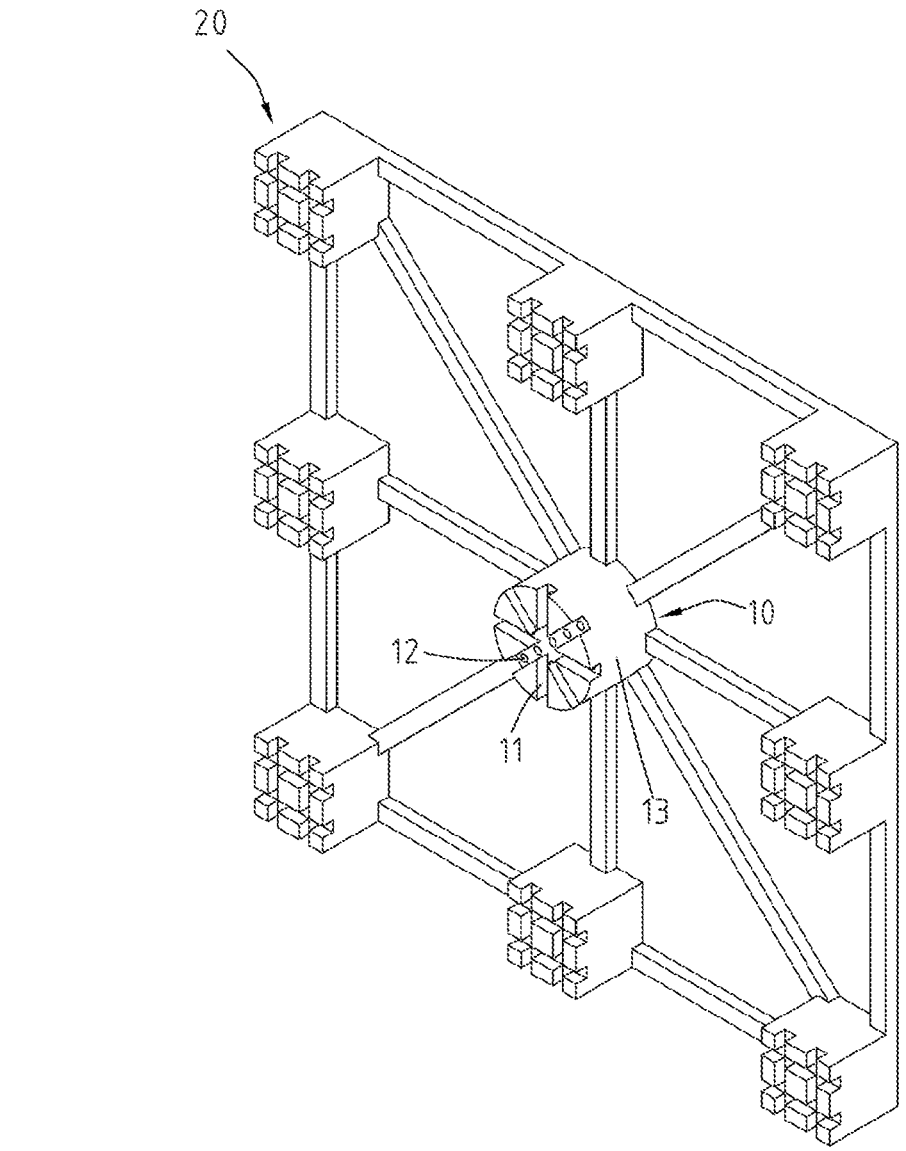
FIG. 1 is a schematic view of the instant disclosure.
Figure 2:
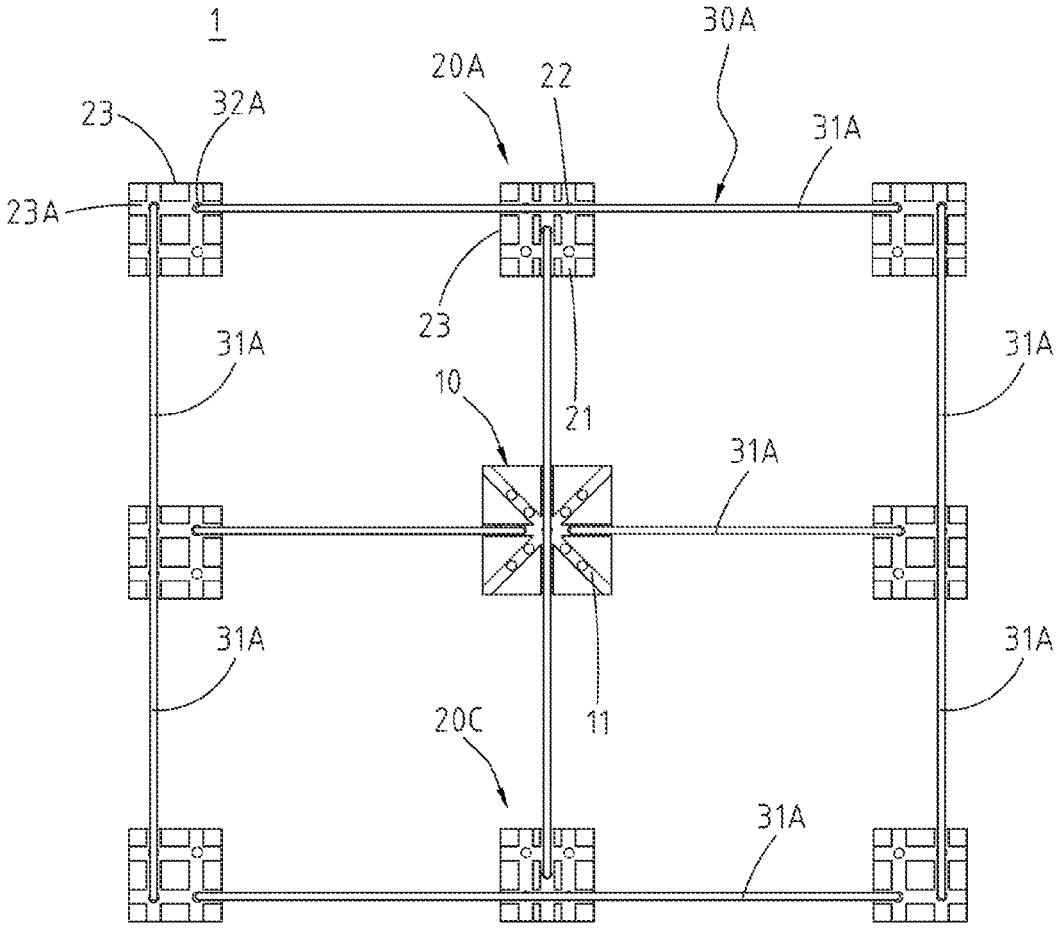
FIG. 2 is a top view of the instant disclosure.
Figure 3:
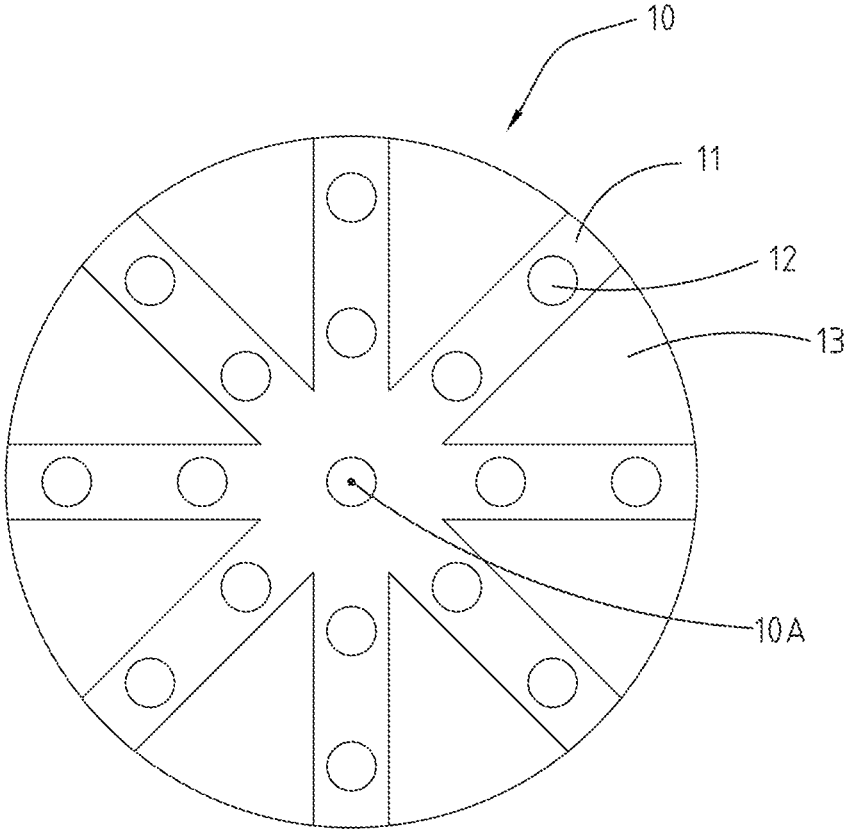
FIG. 3 is an enlarged view of a central base member of the instant disclosure.
Figure 4:
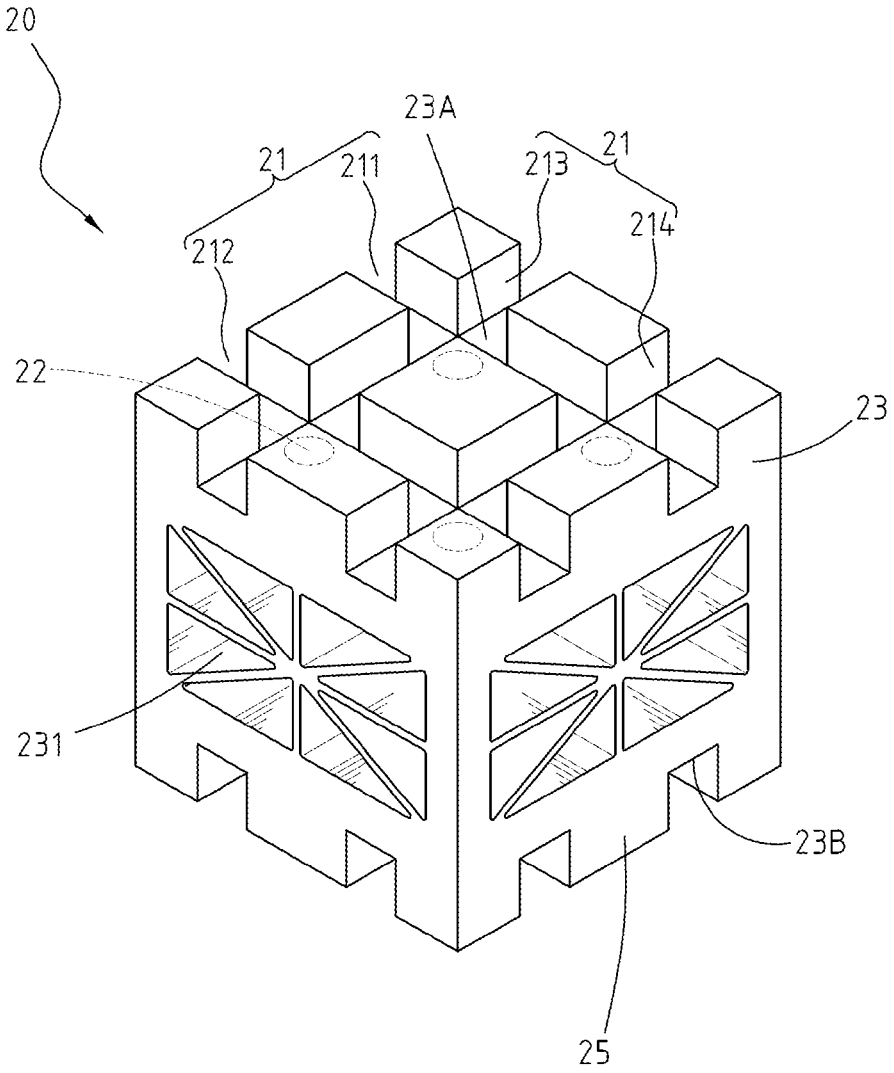
FIG. 4 is a schematic view a side base member of the instant disclosure.
Figure 8:
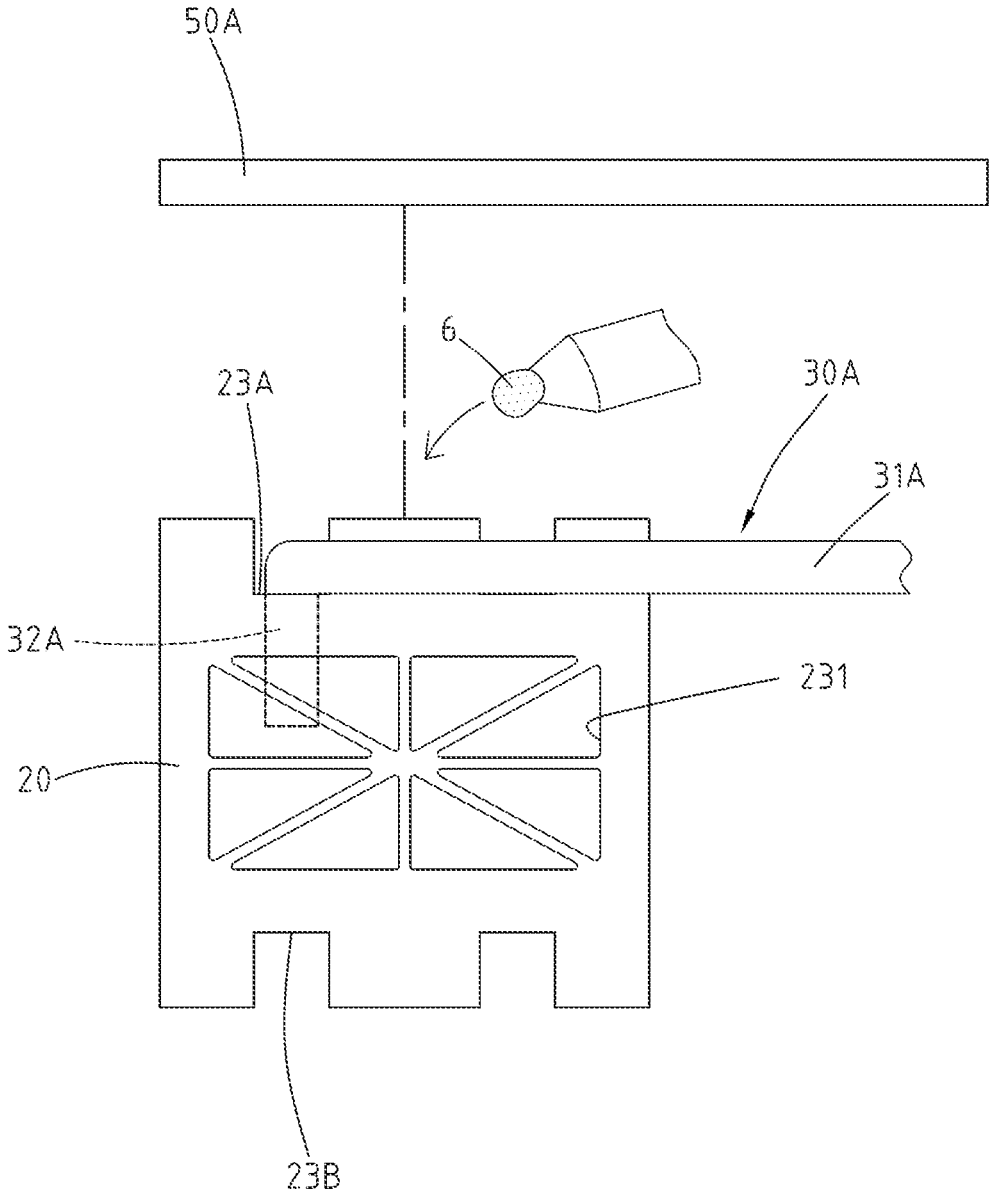
FIG. 8 is an exploded view of a loading plate securing to the side base member.

Please refer to FIGS. 1~4, which show a size adjustable assemblable pallet 1 for a first embodiment of the instant disclosure. In particular, FIG. 1 is a schematic view showing the appearance of the pallet 1, FIG. 2 shows a top view of the pallet 1, FIG. 3 is an enlarged view of a central base member 10 of the pallet 1, and FIG. 4 is a schematic view showing the appearance of a side base member 20 of the pallet 1. The pallet 1 comprises the central base member 10 and a plurality of side base members 20, connecting bars 30A, and loading plates 50A (as shown in FIG. 8).

The central base member 10 can be formed by plastic ejection molding and includes a main body 13, which defines a plurality of positioning grooves 11. The positioning grooves 11 cross each other at a junction 10A. For the instant embodiment, the central base member 10 is disc-shaped as shown in FIGS. 1 and 3. However, the central base member 10 may also be cube-shaped (as shown in FIG. 2). The positioning grooves 11 are defined on one surface of the central base member 10 and each is angled at substantially 45 degrees from adjacent grooves. As a whole, the positioning grooves 11 are arranged in a *-like pattern. In other words, positioning grooves 11 arranged in a cross-like pattern are laid over with positioning grooves 11 oriented in a diagonal manner.

For another configuration of the instant embodiment, the central base member 10 further defines a plurality of positioning holes 12. The positioning holes 12 are defined within the positioning grooves 11 with a depth greater than that of the positioning grooves 11. One of the positioning holes 12 may be formed at the junction 10A.

The side base members 20 are arranged surroundingly about the central base member 10 and correspondingly to the positioning grooves 11. For the instant embodiment, preferably eight side base members 20 are provided correspondingly to the *-patterned positioning grooves 11. As a whole, the central base member 10 and the side base members 20 are disposed in a 3×3 array, with the central base member 10 being in the center.

Figure 9A:
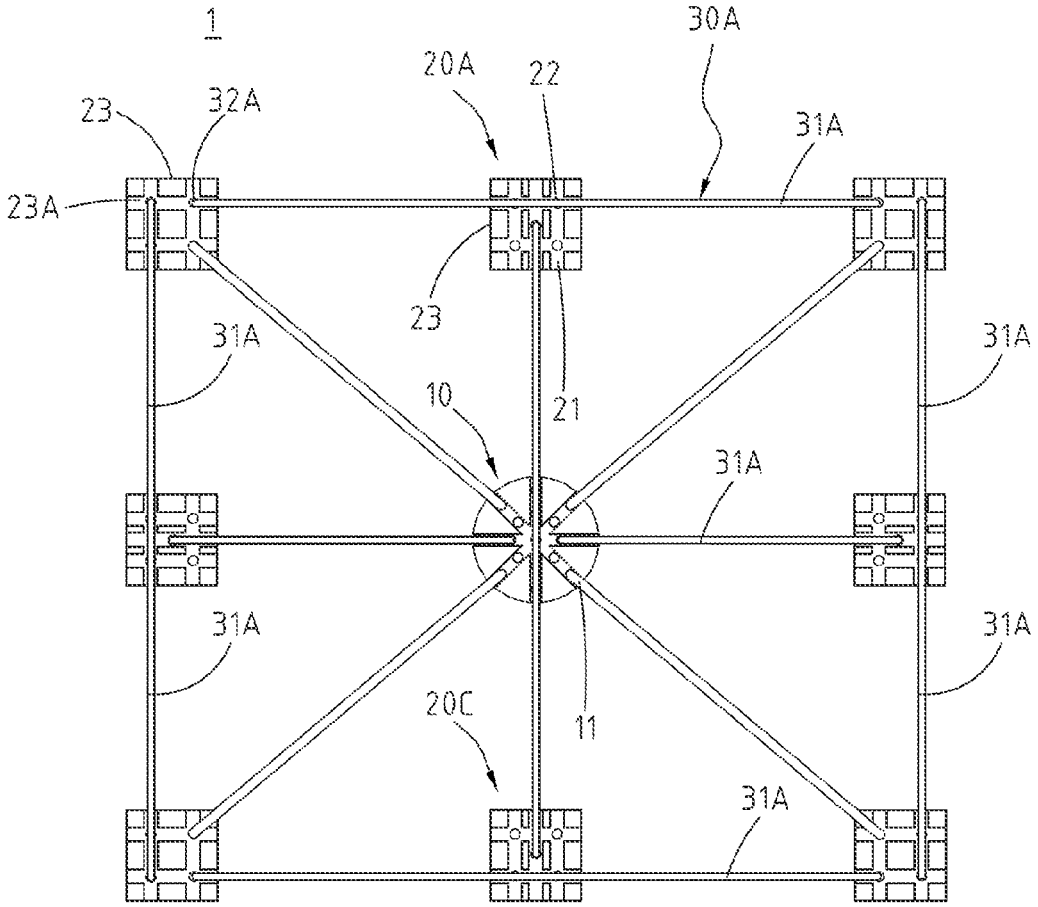
FIG. 9A is a top view of the connecting bars and side base members.
Figure 9B:
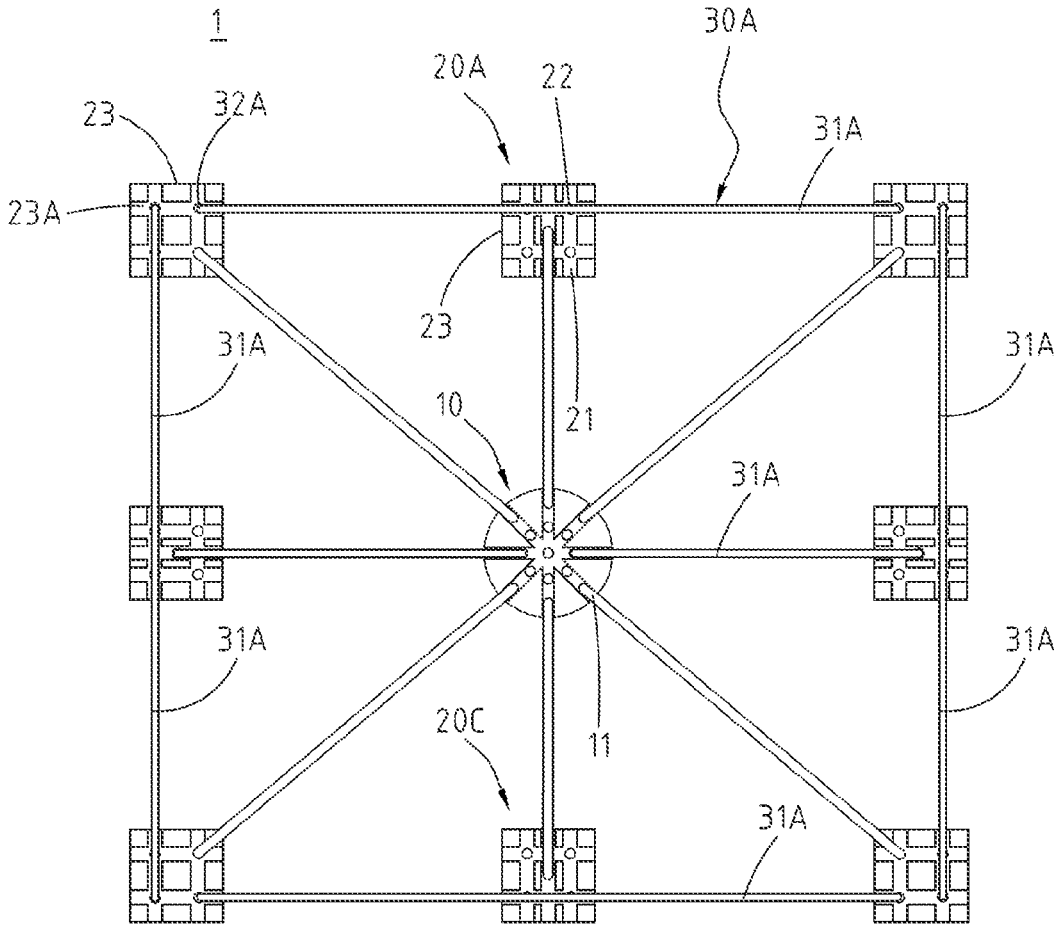
FIG. 9B is another top view of the connecting bars and side base members.
Figure 9C:
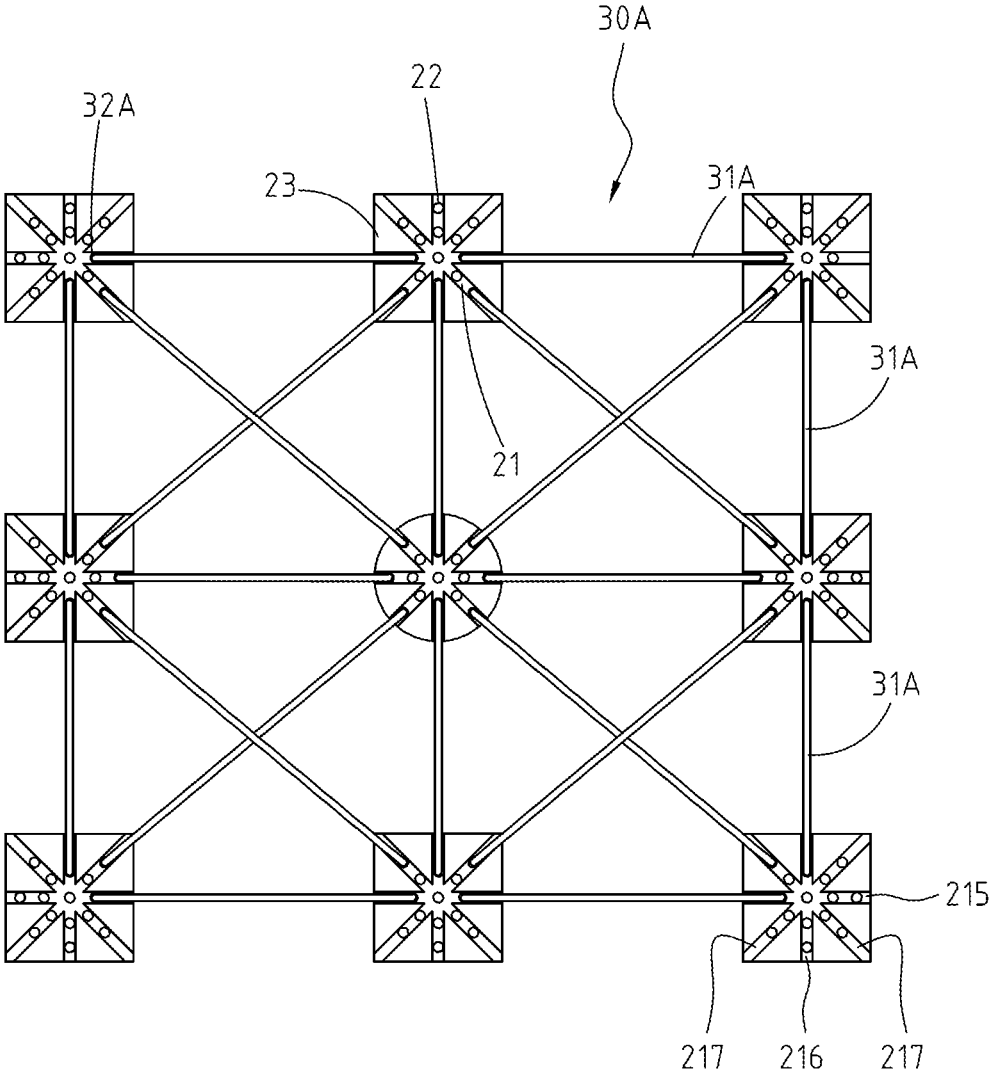
FIG. 9C is yet another top view of the connecting bars and side base members.

The side base members 20 may be formed by plastic ejection molding, with each including a base body 23 and a plurality of fixing grooves 21 and fixing holes 22. The fixing grooves 21 are formed on the base body 23 perpendicularly to one another (as shown in FIGS. 9A and 9B), or diagonally (as shown in FIG. 9C). The fixing holes 22 are formed adjacently to the fixing grooves 21 with a depth greater than that of the fixing grooves 21. As shown in FIGS. 4 and 8, the fixing holes 22 are disposed near the intersecting regions of the fixing grooves 21 or at predetermined locations.

In addition, the side base members 20 may be cube-shaped (as shown in FIGS. 9A~9C), rectangular block-shaped, cylinder-shaped, etc. without restriction. As illustrated in FIGS. 9A~9C, multiple cube-shaped base bodies 23 can be utilized to provide a pallet-like structure, with each base body 23 having the fixing grooves 21 disposed in a cross-like manner. Alternatively, multiple cylinder-shaped base bodies 23 may be used as well. For each of the cube-shaped base bodies 23 (or cylinder-shaped bodies), the fixing grooves 21 may also be arranged in a *-like pattern (as shown in FIG. 9C). That is to say, the fixing grooves 21 arranged in a cross-like pattern are laid over with additional fixing grooves 21 disposed diagonally. In addition, the fixing holes 22 are disposed within each of the fixing grooves 21. For cylinder-like base bodies 23, the round and sleek surfaces can reduce the level of damage induced by impact during transport (i.e., by a forklift). Also, the cube- and cylinder-shaped bodies can be used cooperatively. For example, the cube-shaped central base member 10 in FIG. 2 can be replaced by the cylinder type in FIG. 1. Please refer to FIG. 9C. For each side base member 20, the fixing grooves 21 comprise at least a transverse fixing groove 215, a longitudinal fixing groove 216, and two diagonal fixing grooves 217, and the fixing grooves 21 are intersected by an intersection point.

Additionally, the main bodies 13 and base bodies 23 may be hollowed structures to reduce the weight thereof.

For the instant embodiment, the base body 23 of each side base member 20 has a ribbed internal structure 231 with a H-, I-, or X-shaped configuration without restriction. The ribbed structure not only reduces the weight but also enhances the structural rigidness significantly. Additionally, each base body 23 has a first surface 23A and a second surface 23B, with the fixing grooves and holes 21 and 22 formed on the first surface 23A.

Please refer to FIG. 4. A plurality of positioning portions 25 is formed on the second surface 23B of each base body 23. The positioning portions 25 may be protruded structures. It should be noted that the aforementioned structural configuration and location of the position portions 25 are only for exemplary purpose and the instant disclosure is not restricted thereto. For example, the positioning portions 25 may be formed on the first surface 23A and may be dented structures. For each side base member 20, the fixing grooves 21 include a first fixing groove 211, a second fixing groove 212, a third fixing groove 213, and a fourth fixing groove 214, wherein the first fixing groove 211 and the second fixing groove 212 extend from a first edge of the base body 23 to an opposite second edge of the base body 23, and the third fixing groove 213 and the fourth fixing groove 214 extend from a third edge of the base body 23 to an opposite fourth edge of the base body 23.

The connecting bars 30A are for connecting, positioning, and fixing adjacent side base members 20 and opposite side base members 20 with respect to the central base member 10. Each of the connecting bars 30 has a main portion 31A and a pair of bent inserting portions 32A formed oppositely thereof. In other words, the connecting bars 30 are ⊓-shaped, and the diameter of the main portions 31A is substantially less than or equal to the depths of the positioning grooves 11 of the central base members 10 and the fixing grooves 21 of the side base members 20.

Figure 6:
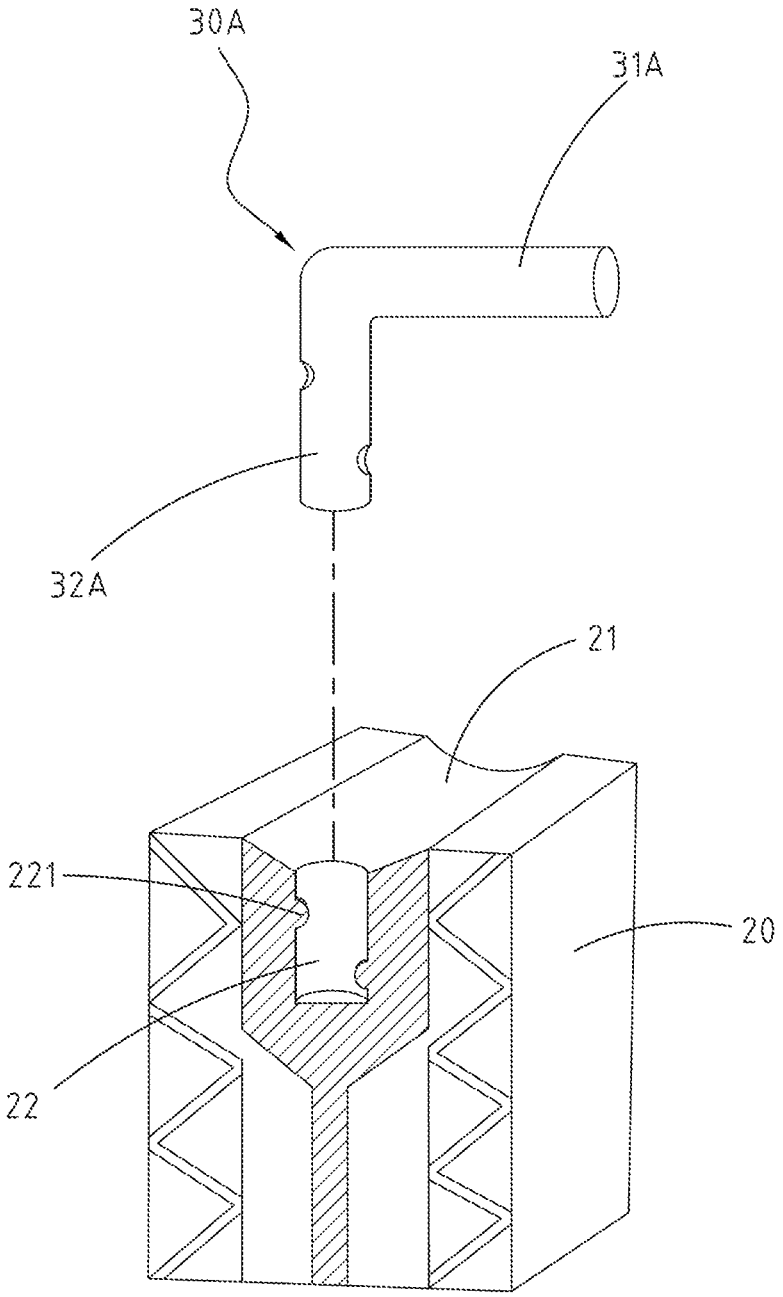
FIG. 6 is an exploded view of a connecting bar engaging the central or side base member.

When the connecting bars 30A are utilized for bridging, positioning, and fixing adjacent side base members 20, the main portions 31A are received by the fixing grooves 21 of the side base members 20 without protruding therefrom. With the main portions 31A being restricted within the fixing grooves 21, the inserting portions 32A of each connecting bar 30A are inserted into respective fixing holes 22 of the side base members 20. Each of the fixing holes 22 is further formed with a locking structure, such as a locking portion 221 shown in FIG. 6. Hence, when the inserting portions 32A are inserted into the fixing holes 22, the inserting portions 32A can self-engage the locking portions 221 to prevent the inserting portions 32A from slipping out of the fixing holes 22. Thus, the side base members 20 are set in position, and the main portions 31A are prevented from slipping out of the fixing grooves 21. Since the side base members 20 are made of plastic material and elastic, only a slight force needs to be applied to the inserting portions 32A to force open the fixing holes 22 and insert the inserting portions 32A therein. Thus, the inserting portions 32A can self-engage with the locking portions 221, in order to prevent the inserting portions 32A from slipping out of the fixing holes 22. Alternatively, the inserting portions 32A may first be inserted into the fixing holes 22, then the inserting portions 32A are turned toward one direction to engage inserting portions 32A with the locking portions 221, so that the side base members 20 can be positioned accordingly and the main portions 31A can be prevented from slipping out of the fixing grooves 21. However, the instant disclosure is not restricted to the above configurations. Also, multiple fixing holes 22 are available within each of the fixing grooves 21. That means the distance between adjacent side base members 20 can be adjusted by inserting the inserting portions 32A into different fixing holes 22. Hence, the size of the assemblable pallet 1 can be adjusted both in the horizontal and vertical directions to satisfy the user needs. As shown in FIG. 9A, long and short main portions 31A can be used cooperatively, while in FIG. 9C, multiple short main portions 31A can be utilized. As in FIG. 9A, short connecting bars 30A can be used to connect side base members 20 located at the middle around the periphery, while long connecting bars 30A can be used to connect other side base members 20.

When the connecting bars 30A are utilized to bridge, position, and fix the side base members 20 on opposite sides of the central base member 10, the main portions 31A are accommodated by the positioning grooves 11 of the central base member 10 without protruding therefrom. With the main portions 31A restricted by the positioning grooves 11, the connecting method and structure (e.g., locking structure), are identical to the aforementioned description, thus no further elaboration is provided herein. The above description also applies to bridge, position, and fix the central base member 10 with the side base members 20.

Figure 5:
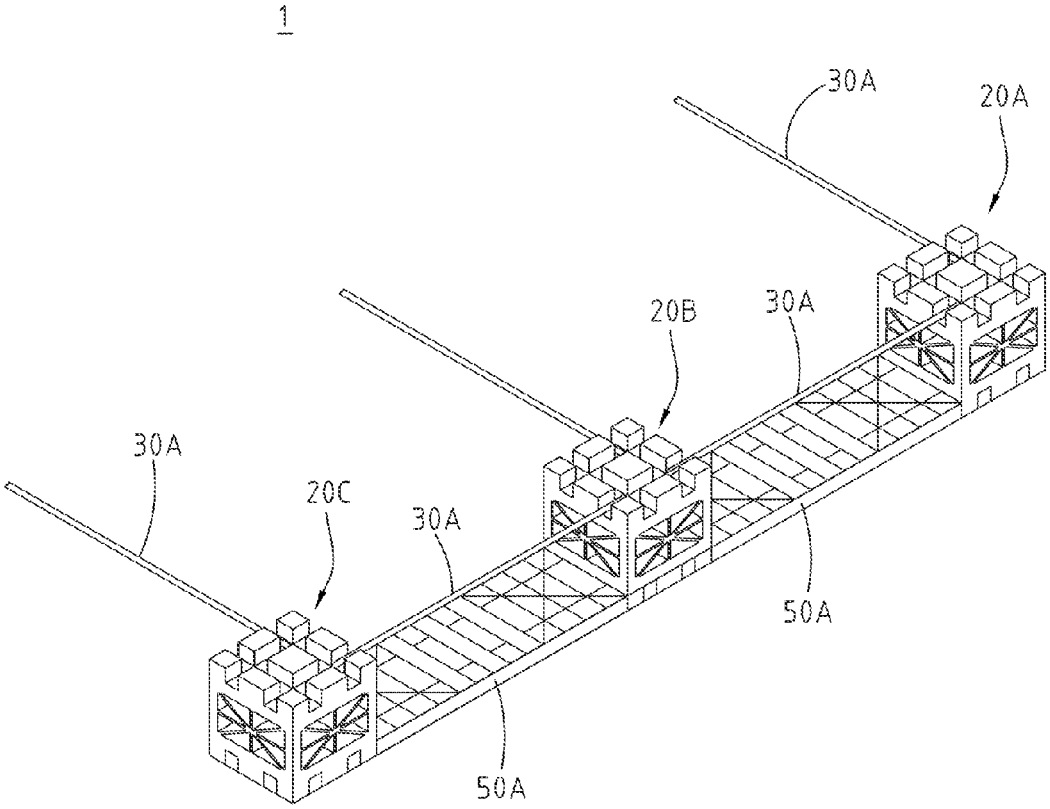
FIG. 5 is a schematic view showing the connection between the connecting bars and the side base members.

The connecting bars 30A and the side base members 20 can be assembled to provide a rigid frame body. Since the main portions 31A are received by the fixing grooves 21 of the side base members 20, the top surface of the frame body is smooth and suitable for mounting the loading plates 50A (as shown in FIGS. 5 and 8). The mounted loading plates 50A would stay evenly to allow greater usage.

Figure 7:
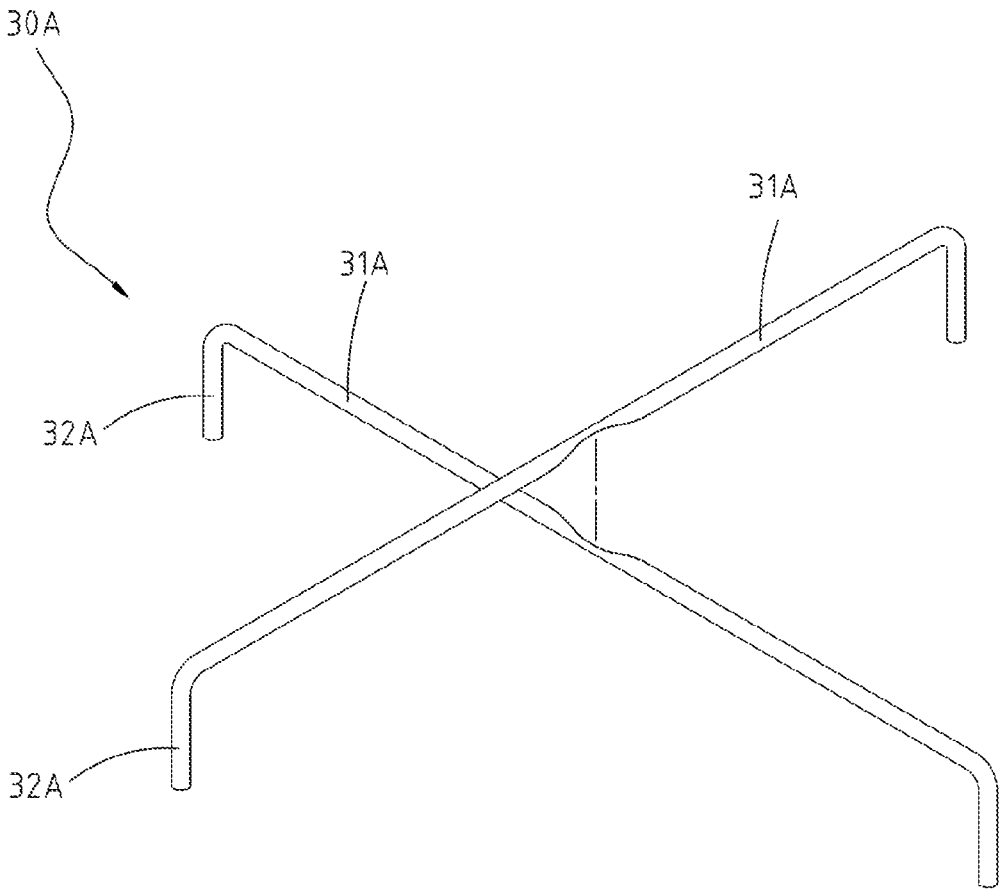
FIG. 7 is a schematic view of the connecting bars.

For the instant disclosure, as shown in FIG. 9A, since each of the side base members 20 is furnished with multiple fixing holes 22, thus the connecting bars 30A for positioning the side base members 20 can be parallel to one another, arranged along a straight line, or perpendicular to one another without intersecting. Alternatively, the connecting bars 30A may also cross one another as shown in FIG. 7. For such case, the intersecting region of the main portion 31A can be dented, so as to ensure the connecting bars 30A received in the fixing grooves 21 do not protrude therefrom. Thus, the top surfaces of the connected side base members 20 can stay flat.

For the instant embodiment, the connecting bars 30A can be of metallic tubing such as square, round, or trapezoid tubes but are not limited thereto.

The loading plates 50 may be chipboards, honeycomb boards, or composite boards. The plates 50 may be secured to the base bodies 23 via engaging means, adhesives 6 (as shown in FIG. 8), locking means, or heat sealing method. These plates 50 can be secured to either the first surface 23A or the second surface 23B in forming the pallet 1, which can be transported by forklifts or pallet jacks.

Figure 10:
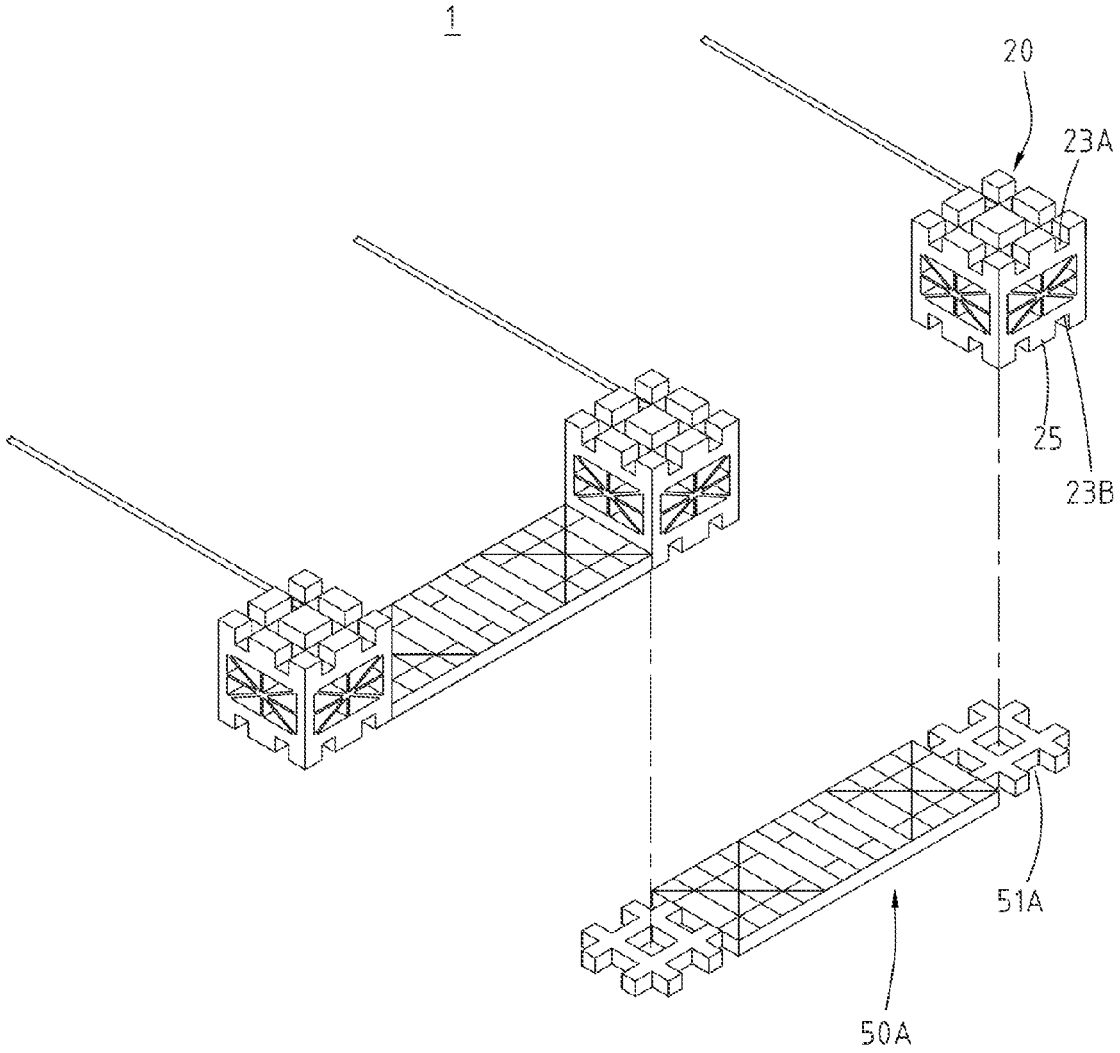
FIG. 10 is a schematic view of the loading plates engaging the side base members.

When engaging means is adopted, the second surface 23B of each side base member 20 defines a plurality of positioning portions 25 (as shown in FIG. 10). Correspondingly, each of the loading plates 50 forms a plurality of combining portions 51A. Hence, the loading plates 50 can be secured to the side base members 20 by engaging the combining portions 51A to the positioning portions 25. For the instant embodiment, the positioning portions 25 may be protruded structures, while the combining portions 51A may be recessed structures, or vice versa, but are not limited thereto. The positioning portions 25 may also be formed on the first surface 23A of each of the side base members 20.

Figure 11:
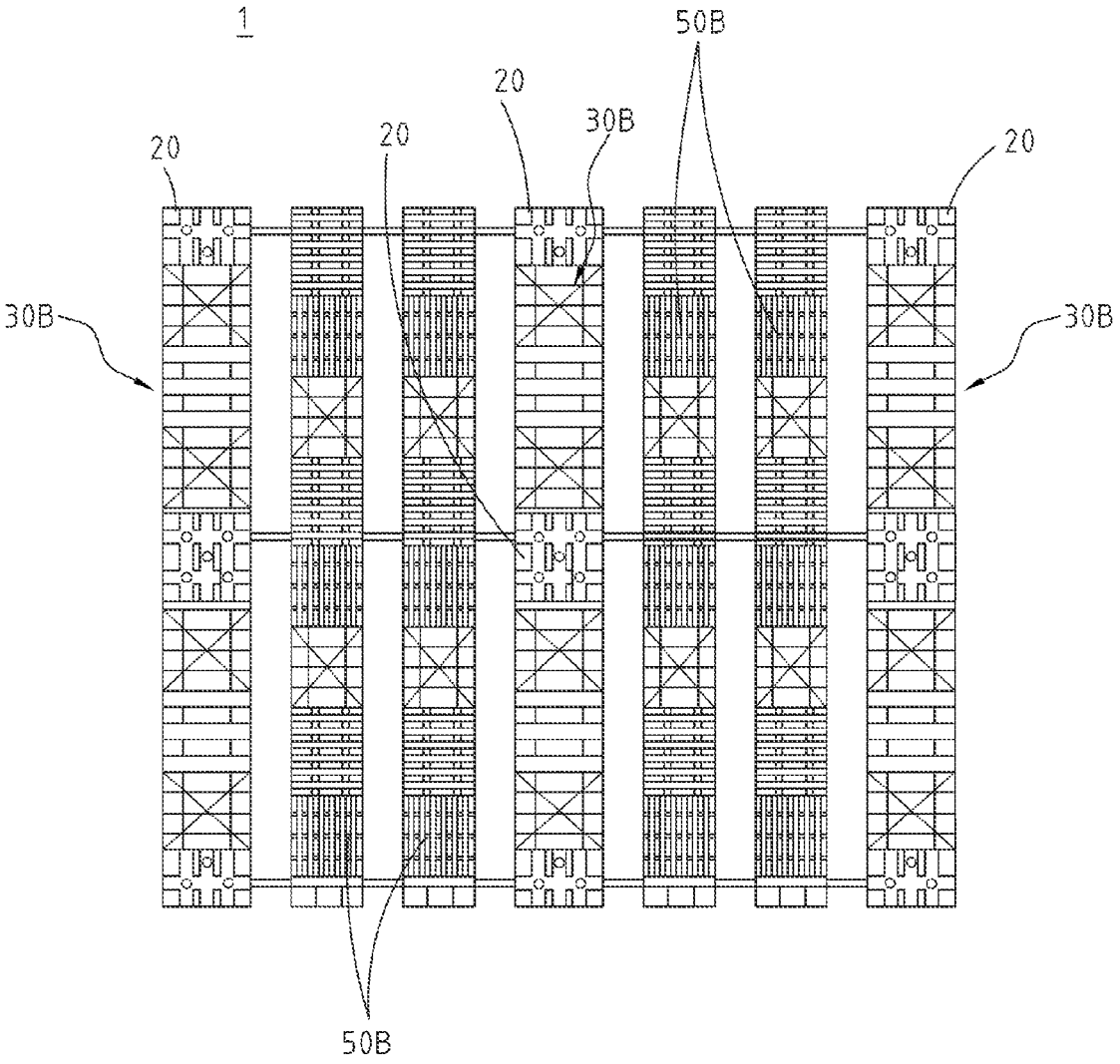
FIG. 11 is a top view of the frame body for a first embodiment of the instant disclosure.

For the instant embodiment, when assembling the pallet 1, the side base members 20 are connected and positioned accordingly by the connecting bars 30A. In particular, the inserting portions 32A of each of the connecting bars 30 can be inserted into selected fixing holes 22 of the side base members 20. Thereby, a flat frame body (as shown in FIG. 11), can be provided via the side base members 20 and the connecting bars 30A. This frame body is structurally rigid, balanced, and each component does not get displaced. Finally, the loading plates 50A are secured to this frame body by adhesion, engaging means, heat sealing, etc.

As shown in FIG. 5, the side base members 20 are labeled 20A, 20B, and 20C, with each of the side base members 20B being in between the side base members 20A and 20C. One of the connecting bars 30A is utilized to bridge the side base members 20A, 20B, and 20C, with the main portion 31A partially received in the fixing groove 21 of the side base member 20B. That is to say, one connecting bar 30A is capable of fixing and positioning up to three side base members, namely 20A, 20B, and 20C.

Figure 12:
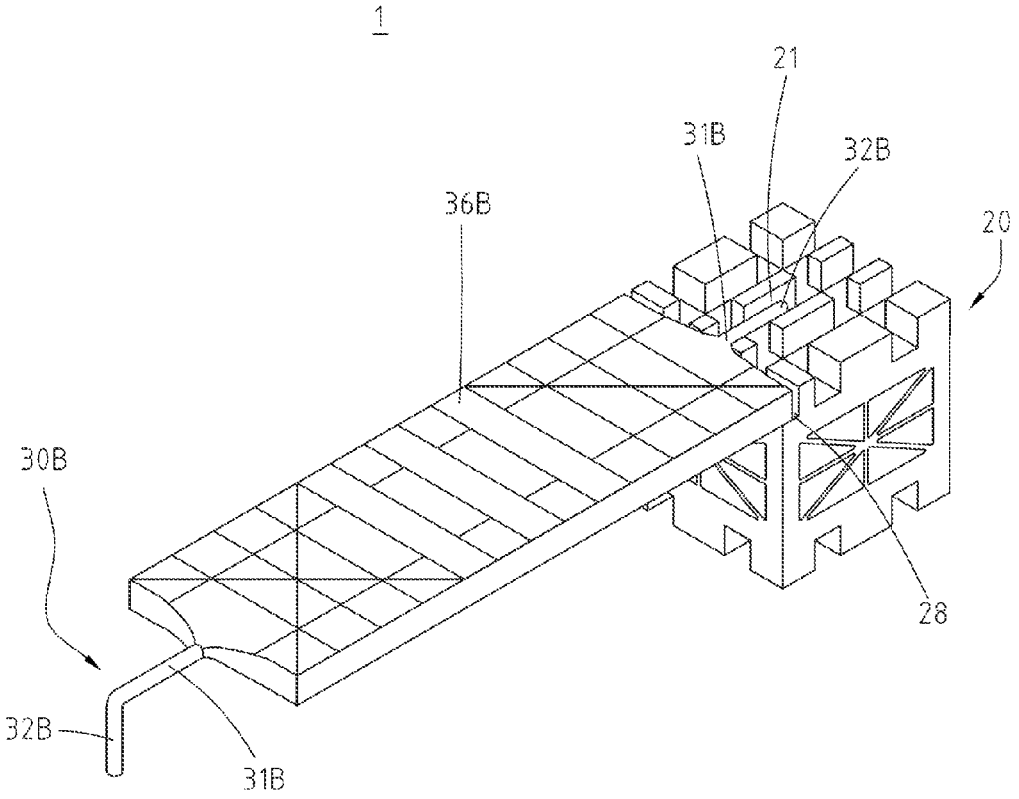
FIG. 12 is a schematic view for a second embodiment of the instant disclosure.

Please refer to FIG. 12, which is a schematic view illustrating a second embodiment of the instant disclosure. For the instant embodiment, the loading plates 50A are secured to the connecting bars 30B.

That is, the loading plate 50A and the connecting bars 30B are formed integrally in one piece. For example, the connecting bars 30B may be lamellar shaped via plastic ejection molding. Each of the connecting bars 30B includes a plate portion 36B, an extending portion 31B protruding from opposite ends of the plate portion 36B (penetrating the plate portion 36B), and a pair of attaching portions 32B. The plate portion 36B has a hollow interior with ribbed structures to enhance the rigidity of the connecting bars 30B.

For the instant embodiment, the plate portions 36B of the connecting bars 30B may replace the loading plates 50A in the previous embodiment, with both having the same function. That is to say the plate and the connecting bar 30B are formed integrally in one piece. As shown in FIG. 12, each of the side base members 20 defines a stepped portion 28. When assembling the pallet 1, the ends of each plate portion 36B are received by the stepped portions 28 of the corresponding side base members 20. Meanwhile, the extending portion 31B of each connecting bar 30B is received by the fixing groove 21 of the corresponding side base member 20. The attaching portions 32B are inserted into respective fixing holes 22 of the side base members 20.

The side base members 20 are arranged surroundingly (including all corners), in providing the pallet structure. The attaching portions 32B may be inserted into different fixing holes 22 of the side base members 20, in order to adjust the distance between adjacent side base members 20 (e.g., different fixing holes 22 shown in FIG. 4). Hence, the size of the pallet 1 can be adjusted in both horizontal and vertical directions.

Figure 13:
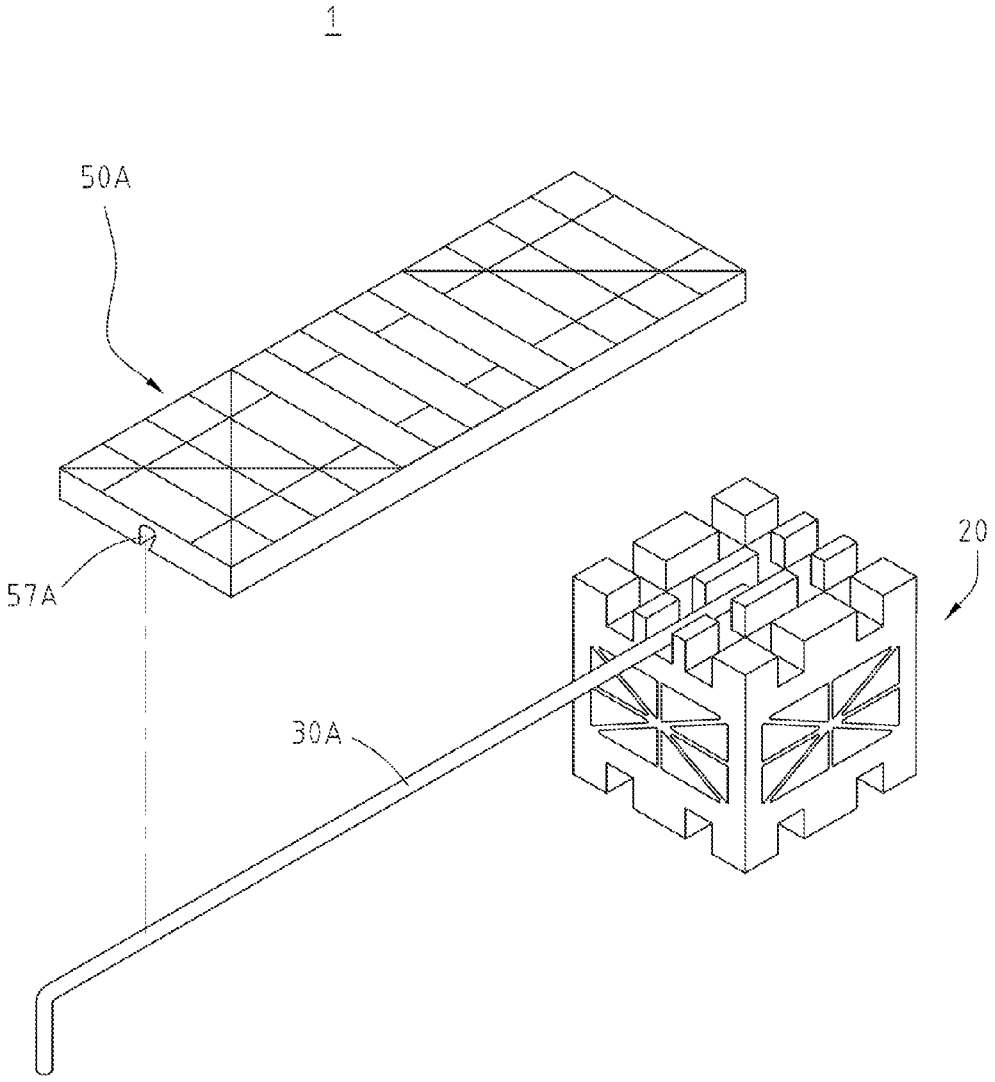
FIG. 13 is another schematic view of the loading plates engaging with the side base members.

Please refer to FIG. 13, which shows another configuration of securing a plate member to a connecting bar. For this configuration, each loading plate 50A is formed with at least one elongated recess 57A underneath thereof, so that the loading plate 50A can be fixed onto the connecting bar 30A. The recess 57A is an elongated channel having an approximately Ω-shaped cross-section. In particular, the width of the inner portion of the recess 57A is substantially greater than that of the opening portion thereof, and the width of the opening portion is substantially less than the overall width of the connecting bar 30A. More specifically, one face of the inner surface of the recess 57A is substantially perpendicular to the outer bottom surface of the loading plate 50A, while another face thereof is substantially non-perpendicular with respect to the outer bottom surface of the loading plate 50A but rather oriented at an angled direction. This way, the connecting bar 30A can be easily secured by the recess 57A via the opening portion thereof.

Figure 14A:
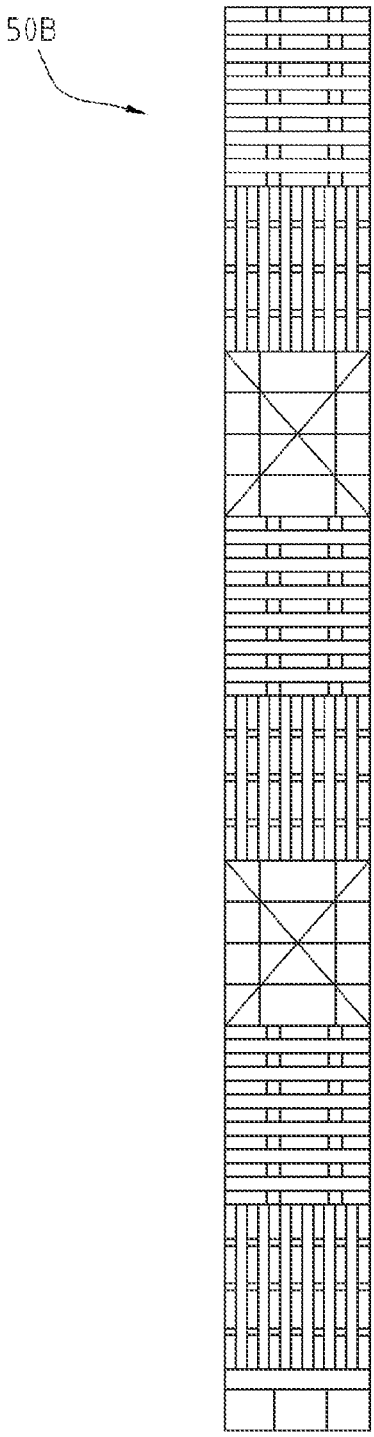
FIG. 14A is a top view of multiple loading plates for a third embodiment of the instant disclosure.
Figure 14B:
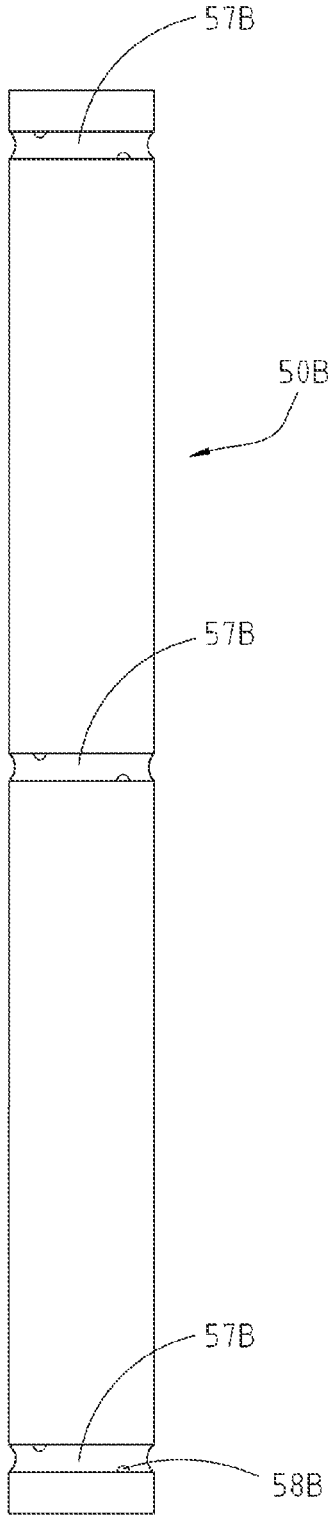
FIG. 14B is a bottom view of multiple loading plates for the third embodiment of the instant disclosure.
Figure 15:
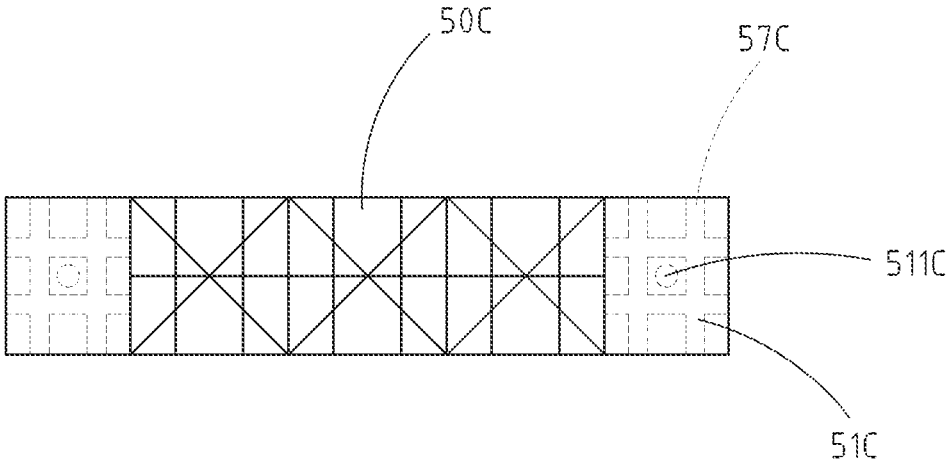
FIG. 15 is another top view of multiple loading plates for the third embodiment of the instant disclosure.

Next, please refer to FIGS. 14A, 14B, and 15, which show a third embodiment of the instant disclosure. Namely, FIG. 14A is a top view of multiple loading plates, while FIG. 14B is a bottom view of these plates, with FIG. 15 being another top view of the plates. For the instant embodiment, reference numerals 50B and 50C are used to denote the loading plates 50A of the first embodiment.

For the instant embodiment, the connecting bars 30A are employed to bridge and position various side base members 20. Namely, the attaching portions 32B of the connecting bars 30A can be inserted into the fixing holes 22 of the side base members 20. Now, as shown in FIGS. 11 and 14A, smaller loading plates 50B may be used to replace the larger loading plates 50A. Each of these loading plates 50B may be obtained by plastic ejection molding, with a hollow but ribbed interior having X, H, or II-shaped structure to enhance structural integrity. Additionally, the underside of each loading plate 50B is formed with a plurality of recesses 57B, where each recess 57B defines a plurality of engaging members 58B (as shown in FIG. 14B). Hence, the loading plates 50B can be secured onto the connecting bars 30A. In addition, the loading plates 50B are arranged in parallel with one another. Each loading plate 50B preferably has three recesses 57B, with the top, middle, and bottom portion of the loading plate 50B each having one recess 57B.

Next, as shown in FIG. 15, the loading plates 50C may be obtained by plastic ejection molding and have hollow interior with ribbed structure. The ribbed structure could be X, H, or II-shaped for enhancing the structural strength. A flat head 51C is formed at each of the opposite ends of every loading plate 50C, where each flat head 51C is formed with a fixing member 511C. The fixing member 511C could be a round insert for inserting into one of the fixing holes 22 of the side base member 20. Thus, the loading plates 50C can be secured to the side base members 20. In addition, the recesses 57C can receive the main portions 31A of the connecting bars 30A, such that the loading plates 50C can be secured onto the connecting bars 30A.

Figure 16:
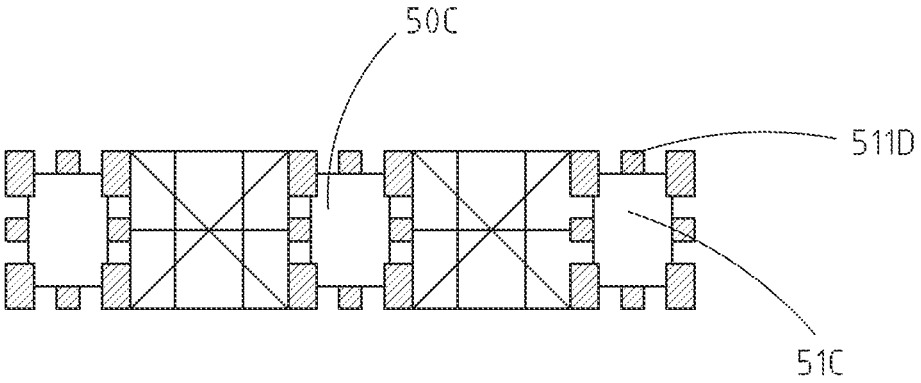
FIG. 16 is yet another top view of multiple loading plates for the third embodiment of the instant disclosure.

Alternatively, each of the flat heads 51C may define a plurality of protrusions 511D (as shown in FIG. 16) in replacement of the fixing member 511C. The protrusions 511D can be inserted into the fixing grooves 21 of the side base members 20, in order to secure the loading plates 50C onto the side base members 20. The loading plates 50B and 50C can be arranged in parallel with one another, while the loading plates 50C can be disposed surroundingly in forming the pallet 1. Additionally, the loading plates 50C are arranged in parallel with one another or along a straight line. The connecting bars 30A are parallelly disposed and perpendicular to the loading plates 50B and 50C.

By using the connecting bars and the loading plates 50B and 50C, various side base members 20 could be bridged, positioned, and held together in providing the pallet 1. This pallet structure is rigid, balanced, and its components would not be displaced from one another. The side base members 20 are arranged surroundingly including the corner locations of the pallet structure.

For the instant disclosure, the inserting portions can be inserted into different fixing holes of the side base members, in order to adjust the distance between adjacent side base members. In addition, connecting bars of different length can be utilized as well to adjust the size of the pallet in both horizontal and vertical directions.

While the instant disclosure has been described by way of example and in terms of the preferred embodiments, it is to be understood that the instant disclosure needs not be limited to the disclosed embodiments. For anyone skilled in the art, various modifications and improvements within the spirit of the instant disclosure are covered under the scope of the instant disclosure. The covered scope of the instant disclosure is based on the appended claims.

What is claimed is:

1. A size adjustable assemblable pallet, comprising:

a central base member including a main body and a plurality of positioning grooves, the positioning grooves being formed on the main body and intersecting at a junction, wherein the positioning grooves are symmetrically arranged by taking the junction as a point-symmetrical center, and two ends of each of the positioning grooves are on a periphery of the central base member and a connection line of the two ends passes through the junction;

a plurality of corner side and center side base members, each side base member having a same structure and including a base body and a plurality of fixing grooves, the fixing grooves being formed on the base body, and the fixing grooves intersect with each other;

a plurality of connecting bars, each connecting bar including a main portion and a plurality of inserting portions, the inserting portions being bent in a same direction from respective ends of the main portion, the main portion to be received by the fixing grooves of two side base members or one of the fixing grooves of one side base member and one of the positioning grooves of the central base member;

wherein when received by the fixing grooves of the two side base members, both side members are interconnected to each other, and when received by one of the fixing grooves of one side base member and one of the positioning grooves of the central base member, the side base member and the central base member are interconnected to each other; and a plurality of loading plates secured onto the side base members.

2. A size adjustable assemblable pallet, comprising:

a central base member including a main body and a plurality of positioning grooves, the positioning grooves being formed on the main body and intersecting at a junction, wherein the positioning grooves are symmetrically arranged by taking the junction as a point-symmetrical center, and two ends of each of the positioning grooves are on a periphery of the central base member and a connection line of the two ends passes through the junction;

a plurality of corner side and center side base members, each side base member having a same structure including a base body and a plurality of fixing grooves, the fixing grooves being formed on the base body, and the fixing grooves intersect with each other;

a plurality of connecting bars, each connecting bar including a main portion and a plurality of inserting portions, the inserting portions being bent in a same direction from respective ends of the main portion, the main portion to be received by the fixing grooves of two side base members or one of the fixing grooves of one side base member and one of the positioning grooves of the central base member;

wherein when received by the fixing grooves of the two side base members, both side members are interconnected to each other, and when received by one of the fixing grooves of one side base member and one of the positioning grooves of the central base member, the side base member and the central base member are interconnected to each other; and a plurality of loading plates secured onto the connecting bars.

3. The pallet of claim 1, wherein each of the loading plates is secured to the side base members by adhesion, heat sealing, or locking means.

4. The pallet of claim 1, wherein each of the base bodies further has a positioning portion, and each of the loading plates has a combining portion, and wherein the combining portion is engaged to the positioning portion to secure the loading plate onto the base body.

5. The pallet of claim 4, wherein each of the base bodies further has a first surface and a second surface, with the fixing grooves formed on the first surface.

6. The pallet of claim 3, wherein each of the base bodies further has a first surface and a second surface, with the fixing grooves formed on the first surface.

7. The pallet of claim 6, wherein each of the base bodies further has a positioning portion, and each of the loading plates has a combining portion, and wherein the combining portion is engaged to the positioning portion to secure the loading plate onto the base body, and wherein the positioning portion is formed on the first or second surface.

8. The pallet of claim 5, wherein the positioning portion is formed on the first or second surface.

9. The pallet of claim 2, wherein each of loading plates defines a recess for engaging the main portion.

10. The pallet of claim 2, wherein at least one loading plate and one connecting bar are formed integrally in one piece.

11. The pallet of claim 2, wherein the central base member further defines a plurality of positioning holes within the positioning grooves, with the depth of the positioning holes being greater than that of the positioning grooves, wherein each of the side base members further defines a plurality of fixing holes within the fixing grooves, with the depth of the fixing holes being greater than that of the fixing grooves, wherein the inserting portions are inserted into the fixing holes of two side base members or one of the fixing holes of one side base member and one of the positioning holes of the central base member.

12. The pallet of claim 1, wherein the central base member further defines a plurality of positioning holes within the positioning grooves, with the depth of the positioning holes being greater than that of the positioning grooves, wherein each of the side base members further defines a plurality of fixing holes within the fixing grooves, with the depth of the fixing holes being greater than that of the fixing grooves, wherein the inserting portions are inserted into the fixing holes of two side base members or one of the fixing holes of one side base member and one of the positioning holes of the central base member.

13. The pallet of claim 12, wherein each of the fixing holes and each of the positioning holes defines a locking portion, and each of the connecting bars further defines an anchoring region on each of the inserting portions, and wherein when the inserting portions are inserted into the fixing holes, the anchoring regions engage the locking portions to secure the inserting portions onto the side base members, and when the inserting portions are inserted into the positioning holes, the anchoring regions engage the locking portions to secure the inserting portions onto the central base member.

14. The pallet of claim 11, wherein each of the fixing holes and each of the positioning holes defines a locking portion, and each of the connecting bars further defines an anchoring region on each of the inserting portions, and wherein when the inserting portions are inserted into the fixing holes, the anchoring regions engage the locking portions to secure the inserting portions onto the side base members, and when the inserting portions are inserted into the positioning holes, the anchoring regions engage the locking portions to secure the inserting portions onto the central base member.

15. The pallet of claim 2, wherein each of the main portions defines a dent region and when two connecting bars cross each other, the respective dent regions are disposed in a stacked manner.

16. The pallet of claim 1, wherein each of the main portions defines a dent region and when two connecting bars cross each other, the respective dent regions are disposed in a stacked manner.

17. The pallet of claim 2, wherein each of the base bodies has ribbed interior structures.

18. The pallet of claim 1, wherein each of the base bodies has ribbed interior structures.

19. The pallet of claim 1, wherein for each side base member, the fixing grooves include a first fixing groove, a second fixing groove, a third fixing groove, and a fourth fixing groove, wherein the first fixing groove and the second fixing groove extend from a first edge of the base body to an opposite second edge of the base body, and the third fixing groove and the fourth fixing groove extend from a third edge of the base body to an opposite fourth edge of the base body.

20. The pallet of claim 1, wherein for each side base member, the fixing grooves comprise at least a transverse fixing groove, a longitudinal fixing groove, and two diagonal fixing grooves, and the fixing grooves are intersected by an intersection point.

21. The pallet of claim 2, wherein for each side base member, the fixing grooves include a first fixing groove, a second fixing groove, a third fixing groove, and a fourth fixing groove, wherein the first fixing groove and the second fixing groove extend from a first edge of the base body to an opposite second edge of the base body, and the third fixing groove and the fourth fixing groove extend from a third edge of the base body to an opposite fourth edge of the base body.

22. The pallet of claim 2, wherein for each side base member, the fixing grooves comprise at least a transverse fixing groove, a longitudinal fixing groove, and two diagonal fixing grooves, and the fixing grooves are intersected by an intersection point.

* * * * *